US007189210B1

(12) United States Patent
Hillman

(10) Patent No.: US 7,189,210 B1
(45) Date of Patent: Mar. 13, 2007

(54) FOOT MASSAGING METHOD AND DEVICE

(76) Inventor: Tiffany Hillman, 73 Forest St., Apartment 1 L, Montclair, NJ (US) 07042

( * ) Notice: Subject to any disclaimer, the term of this patent is extended or adjusted under 35 U.S.C. 154(b) by 0 days.

(21) Appl. No.: 11/177,662

(22) Filed: Jul. 11, 2005

(51) Int. Cl.
*A61H 1/00* (2006.01)

(52) U.S. Cl. ..... 601/27; 601/28

(58) Field of Classification Search ..... 601/27–32
See application file for complete search history.

(56) References Cited

U.S. PATENT DOCUMENTS 2,638,089 A * 5/1953 Murphy ..... 601/27
3,705,579 A 12/1972 Morini et al.
4,577,625 A * 3/1986 Lohati et al. ..... 601/128
4,785,800 A 11/1988 Stilson
5,005,560 A 4/1991 Quam et al.
D387,871 S 12/1997 Childs et al.
D408,544 S 4/1999 Kalat
6,102,876 A 8/2000 Winger

* cited by examiner

*Primary Examiner*—Michael A. Brown

(57) ABSTRACT

A foot massaging method and device includes a first spherical member and a second spherical member. Each of the first and second spherical members is comprised of a resiliently compressible material and each has a substantially same size. A connector is attached to and extends between the first and second spherical members. The connector is comprised of a resiliently compressible material and has a first end attached to the first spherical member and a second end attached to the second spherical member. The connector has a circular cross-section taken perpendicular to a line extending through the first and second ends and through the axis of the first and second spherical members. The connector is positioned against a sole of a foot and rolled along the sole so that the connector and the first and second spherical members massage the foot.

5 Claims, 1 Drawing Sheet

FOOT MASSAGING METHOD AND DEVICE

BACKGROUND OF THE INVENTION

1. Field of the Invention

The present invention relates to foot massaging devices and more particularly pertains to a new foot massaging device for massaging the sole and outer edges of a foot.

2. Description of the Prior Art

The use of foot massaging devices, and massaging devices in general, is known in the prior art. U.S. Pat. No. 4,785,800 describes a device used for massaging the neck of a person by the person leaning back into the device and moving the device up and down along the neck. A device of similar structure is found in U.S. Pat. No. 3,705,579 which is used for massing along the length of a spine by rolling the device along the back. A general purpose massager is found in U.S. Des. Pat. No. 408,544 which includes balls having rounded depressions therein which may be used for massaging purposes.

While these devices fulfill their respective, particular objectives and requirements, the need remains for a device that has a structure which is particularly well suited for massaging the feet of a person. The feet carry much of the stress of a person and, depending on the type of occupation of the person, may be subject to many hours of impact each day. For that reason, a device is needed that will effectively massage the soles of the feet to provide stress reduction and to alleviate pain associated with prolonged periods of standing.

SUMMARY OF THE INVENTION

The present invention meets the needs presented above by generally comprising a first spherical member and a second spherical member. Each of the first and second spherical members is comprised of a resiliently compressible material and each has a substantially same size. A connector is attached to and extends between the first and second spherical members so that an axis of each of the first and second spherical members are positioned 3½ inches and 4 inches apart. The connector is comprised of a resiliently compressible material and has a first end attached to the first spherical member and a second end attached to the second spherical member. The connector has a circular cross-section taken perpendicular to a line extending through the first and second ends and through the axis of the first and second spherical members. The connector has a smaller cross-sectional diameter than the first and second spherical members along all points between the first and second ends. The connector is positioned against a sole of a foot and each of the first and second spherical members is placed adjacent to outer edges of the sole. The connector is rolled along the sole so that the connector and the first and second spherical members massage the foot.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
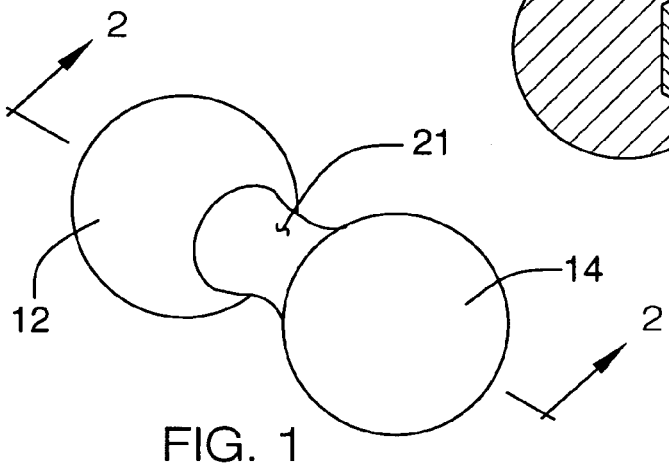
FIG. 1 is a perspective view of a foot massaging method and device according to the present invention.
Figure 2:
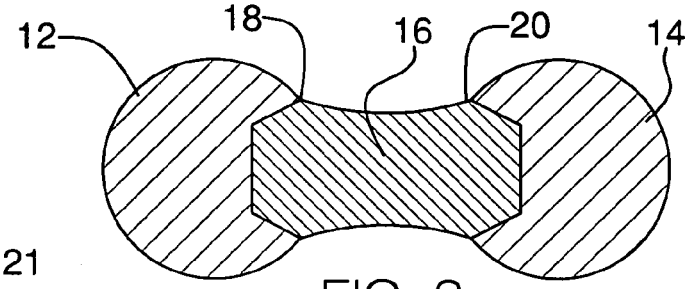
FIG. 2 is a cross-sectional view taken along line 2—2 of FIG. 1 of the present invention.
Figure 5:
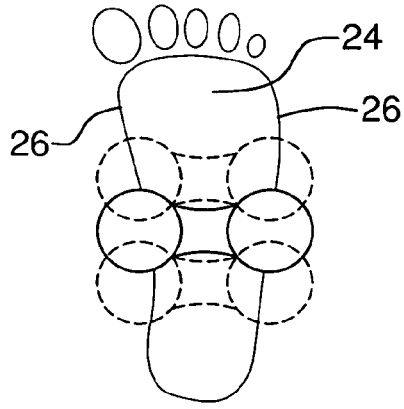
FIG. 5 is a bottom in-use view of the present invention.
Figure 3:
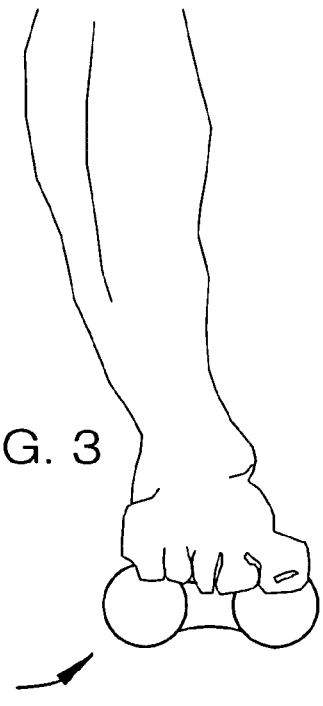
FIG. 3 is a front in-use view of the present invention.
Figure 4:
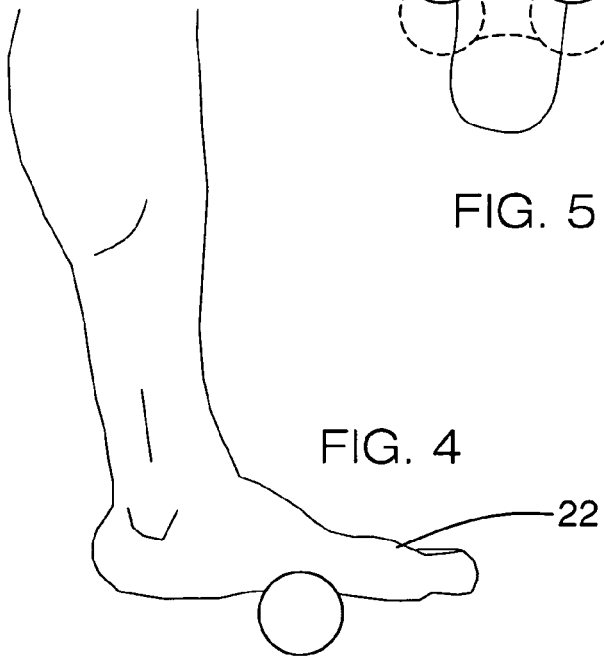
FIG. 4 is a side in-use view of the present invention.

With reference now to the drawings, and in particular to FIGS. 1 through 5 thereof, a new foot massaging device embodying the principles and concepts of the present invention and generally designated by the reference numeral 10 will be described.

As best illustrated in FIGS. 1 through 5, the foot massaging method and device 10 generally comprises a first spherical member 12 and a second spherical member 14. Each of the first 12 and second 14 spherical members are comprised of a resiliently compressible material, such as a solid elastomer or an elastomeric ball having compressed air positioned therein. The first 12 and second 14 spherical members each have a substantially same size. Each of the first 12 and second 14 spherical members has a diameter generally between 2½ inches and 3 inches.

A connector 16 is attached to and extends between the first 12 and second 14 spherical members so that an axis of each of the first 12 and second 16 spherical members are positioned 3½ inches and 4 inches apart. The connector 16 is comprised of a resiliently compressible material. The connector 16 has a first end 18 attached to the first spherical member 12 and a second end 20 attached to the second spherical member 14. The connector 16 has a circular cross-section taken perpendicular to a line extending through the first 18 and second 20 ends and through the axis of the first 12 and second 16 spherical members. The connector 16 has a smaller cross-sectional diameter than the first 12 and second 14 spherical members along all points between and including the first 18 and second 20 ends. The connector 16 has an outer surface 21 that is concavely arcuate so that a diameter of the circular cross-section increases moving from a central point of the connector 16 and toward the first 18 and second 20 ends. A diameter of the central point positioned between the first 18 and second 20 ends is generally between 1 inch and 1½ inches and a diameter of the first 18 and second 20 ends is generally between 1½ inches and 2 inches.

In use, the connector 16 is positioned against a sole 24 of a foot 22 and each of the first 12 and second 16 spherical members is positioned adjacent to outer edges 26 of the sole 24. The connector 16 is then rolled along the sole 24 so that the connector 16 and the first 12 and second 14 spherical members massage the foot 22. The person using the device 10 may also roll the first 12 or second 16 spherical members directly on the sole 24 as well.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of massaging a foot comprising the steps of:

providing a first spherical member and a second spherical member, each of said first and second spherical members being comprised of a resiliently compressible material, said first and second spherical members having a substantially same size;

providing a connector being attached to and extending between said first and second spherical members such that an axis of each of said first and second spherical members are positioned 3½ inches and 4 inches apart, said connector being comprised of a resiliently compressible material, said connector having a first end attached to said first spherical member and a second end attached to said second spherical member, said connector having a circular cross-section taken perpendicular to a line extending through said first and second ends and through said axis of said first and second spherical members, said connector having a smaller cross-sectional diameter than said first and second spherical members along all points between said first and second ends, said connector having a smooth outer surface, a junction of said connector and first and second spherical members being curved, said connector having an outer surface being continuously concavely arcuate from said first spherical member to said second spherical member, a diameter of said circular cross-section increases moving from a central point of said connector and toward said first and second ends;

positioning said connector against a sole of a foot and placing each of said first and second spherical members adjacent to outer edges of the sole; and rolling said connector along the sole so that the connector and the first and second spherical members massage the foot.

2. The method according to claim 1, wherein each of said first and second spherical members has a diameter generally between 2½ inches and 3 inches.

3. The method according to claim 1, wherein a diameter of said central point being generally between 1 inch and 1½ inches.

4. The method according to claim 3, wherein a diameter of said first and second ends being generally between 1½ inches and 2 inches.

5. A method of massaging a foot comprising the steps of:

providing a first spherical member and a second spherical member, each of said first and second spherical members being comprised of a resiliently compressible material, said first and second spherical members having a substantially same size, each of said first and second spherical members having a diameter generally between 2½ inches and 3 inches;

providing a connector being attached to and extending between said first and second spherical members such that an axis of each said first and second spherical members are positioned between 3½ inches and 4 inches apart, a junction of said connector and first and second spherical members being curved, said connector being comprised of a resiliently compressible material, said connector having a first end attached to said first spherical member and a second end attached to said second spherical member, said connector having circular cross-section taken perpendicular to a line extending through said first and second ends and through said axis of said first and second spherical members, said connector having a smaller cross-sectional diameter than said first and second spherical members along all points between said first and second ends, said connector having an outer surface being continuously concavely arcuate from said first spherical member to said second spherical member such that a diameter of said circular cross-section increases moving from a central point of said connector and toward said first and second ends, a diameter of said central point being generally between 1 inch and 1½ inches, a diameter of said first and second ends being generally between 1½ inches and 2 inches;

positioning said connector against a sole of a foot and placing each of said first and second spherical members adjacent to outer edges of the sole; and rolling said connector along the sole so that the connector and the first and second spherical members massage the foot.

* * * * *